US008734055B2

(12) United States Patent
Remery et al.

(10) Patent No.: US 8,734,055 B2
(45) Date of Patent: May 27, 2014

(54) METHOD FOR ASSEMBLING AN OPERATING RIG FOR A FLUID IN A BODY OF WATER AND ASSOCIATED OPERATING RIG

(75) Inventors: Jeroen Remery, Saint Germain en Laye (FR); Romain Vivet, Paris (FR); Christophe Defreslon, Lavau sur Loire (FR); Ange Luppi, Nimes (FR)

(73) Assignee: Technip France (FR)

( * ) Notice: Subject to any disclaimer, the term of this patent is extended or adjusted under 35 U.S.C. 154(b) by 353 days.

(21) Appl. No.: 13/127,244

(22) PCT Filed: Nov. 3, 2009

(86) PCT No.: PCT/FR2009/052123

§ 371 (c)(1),
(2), (4) Date: Jul. 27, 2011

(87) PCT Pub. No.: WO2010/052422

PCT Pub. Date: May 14, 2010

(65) Prior Publication Data

US 2011/0274501 A1 Nov. 10, 2011

(30) Foreign Application Priority Data

Nov. 5, 2008 (FR) ..... 08 57521
Apr. 10, 2009 (FR) ..... 09 52387

(51) Int. Cl.
*F16L 1/15* (2006.01)
*E21B 17/01* (2006.01)

(52) U.S. Cl.
USPC ..... 405/171; 405/172; 405/224.2; 166/350

(58) Field of Classification Search
USPC ..... 405/158, 166, 168.1, 168.3, 169, 170, 405/171, 172, 224, 224.2; 166/350
See application file for complete search history.

(56) References Cited

U.S. PATENT DOCUMENTS 2,701,375 A * 2/1955 Ault ..... 405/171
3,196,958 A * 7/1965 Travers et al. ..... 166/350
6,309,269 B1 * 10/2001 Fulton et al. ..... 405/171

(Continued)

FOREIGN PATENT DOCUMENTS

FR 2 768 457 3/1999
FR 2 911 907 8/2008

(Continued)

OTHER PUBLICATIONS

International Search Report mailed Jan. 14, 2011 in corresponding PCT International Application No. PCT/FR2009/052123.

*Primary Examiner* — Frederick L Lagman
(74) *Attorney, Agent, or Firm* — Ostrolenk Faber LLP

(57) ABSTRACT

This method comprises connecting a downstream point (40) of a pipe (24) to a buoy (26) and completely submerging the buoy (26). It comprises deploying in the body of water (12) an intermediate section (30) of the pipe (24) from the downstream point (40) to at least as far as an upstream point (38), anchoring the upstream point (38), and tensioning the intermediate section (30) to keep it vertical. The height of the buoy (26) is less than 1.5 times its greatest transverse dimension. The method comprises moving the buoy (26) between a remote position and an installed position in line with an anchoring region, keeping the buoy (26) partly submerged on the surface (16) of the body of water.

9 Claims, 10 Drawing Sheets

(56) References Cited

U.S. PATENT DOCUMENTS

| | | | | |
|---|---|---|---|---|
| 6,837,311 | B1 * | 1/2005 | Sele et al. | 405/224.4 |
| 7,025,533 | B1 * | 4/2006 | Mungall et al. | 405/171 |
| 7,059,416 | B2 * | 6/2006 | Dailey et al. | 405/224.2 |
| 7,100,694 | B2 * | 9/2006 | Legras et al. | 405/224.4 |
| 7,572,085 | B2 * | 8/2009 | Luppi | 405/158 |
| 2004/0076478 | A1 * | 4/2004 | Legras et al. | 405/224.2 |
| 2005/0063788 | A1 * | 3/2005 | Clausen | 405/224.2 |
| 2005/0109513 | A1 * | 5/2005 | Dailey et al. | 166/350 |
| 2005/0158126 | A1 * | 7/2005 | Luppi | 405/224.2 |
| 2006/0062635 | A1 | 3/2006 | Mungall et al. | 405/158 |
| 2008/0056826 | A1 * | 3/2008 | Luppi | 405/171 |
| 2009/0126937 | A1 * | 5/2009 | Millheim | 166/350 |
| 2010/0018717 | A1 * | 1/2010 | Espinasse et al. | 405/169 |

FOREIGN PATENT DOCUMENTS

| | | |
|---|---|---|
| GB | 2 024 766 | 1/1980 |
| GB | 2 180 809 | 4/1987 |
| GB | 2 426 496 | 11/2006 |
| WO | WO 00/21825 | 4/2000 |

* cited by examiner

METHOD FOR ASSEMBLING AN OPERATING RIG FOR A FLUID IN A BODY OF WATER AND ASSOCIATED OPERATING RIG

CROSS-REFERENCE TO RELATED APPLICATIONS

The present application is a 35 U.S.C. §§371 national phase conversion of PCT/FR2009/052123, filed Nov. 3, 2009, which claims priority of French Patent Application Nos. 08 57521 and 09 52387, filed Nov. 5, 2008 and Apr. 10, 2009 respectively, the contents of which are incorporated herein by reference. The PCT International Application was published in the French language.

BACKGROUND OF THE INVENTION

The present invention relates to a method for assembling an operating rig for a fluid in a body of water, of the type comprising the following steps:

- bringing a buoy to the surface of the body of water substantially facing an anchoring region on the bottom of the body of water;
- connecting a downstream point of a fluid transport pipe to the buoy;
- completely immerging the buoy under the surface of the body of water before or after the connection step;
- deploying in the body of water an intermediate section of the transport pipe from the downstream point to at least as far as an upstream point;
- anchoring the upstream point on an anchoring element attached to the bottom of the body of water in the anchoring region;
- tensioning the intermediate section of the transport pipe between the downstream point and the upstream point under the effect of the buoyancy of the buoy, in order to maintain the intermediate section substantially vertical in the body of water;
- connecting onto the intermediate section a lower section intended to be connected to the bottom assembly and an upper flexible section intended to be connected to the surface assembly.

Such rigs are intended for transporting a fluid produced in the bottom of a body of water up to the surface through the body of water. This fluid notably consists of liquid and/or gas hydrocarbons and of water collected in production wells made in the bottom of the body of water.

Such a rig generally comprises a lower pipe for connecting to the production assembly positioned on the bottom of the body of water, a substantially vertical rising column, made on the basis of a flexible pipe or a rigid tube, a buoy for maintaining under tension the rising column in its vertical position, and an anchoring element of a lower point of the rising column.

The rig further comprises an upper flexible connecting pipe connecting the rising column to a floating surface assembly.

Thus, the hydrocarbons produced by the bottom assembly are successively transported through the lower connecting pipe, the rising column and the upper connecting pipe up to a surface assembly such as a ship, a platform or a barge, where they may be recovered or transported.

This type of rig has a relatively simple structure, since maintaining it in a vertical position is exclusively ensured by the anchoring element in the bottom of the body of water, and by the tension generated by the buoyancy of the maintaining buoy connected to the upper point of the rising column.

However, such rigs remain difficult to install, notably because of the depth of the body of water, as well as movements at the surface of the body of water due to swell and/or wind.

Thus, the lifting buoy, after having been transported on a ship as far as the site for installing the rig, has to be immersed at a sufficient depth so as not to experience the effects of the swell and of the current. For this purpose, the buoy is gradually lowered in the body of water by lifting it out of the ship with a handling crane as for example described in FR 2 911 907.

In order to allow the pipe to be held vertically in the body of water, the buoy has to be very voluminous, taking into account the weight of the rising column. Thus, the buoy may have a diameter of more than several meters for a height of several tens of meters.

The buoy generally has an elongated cylindrical shape along a vertical axis, notably for facilitating connection of the rising column to the upper connecting pipe, when this connection is carried out under the buoy.

Such an installation method therefore requires the availability of a ship having a lifting crane with very large capacity and a great height.

Such a ship is not always available. Further, the vertically elongated buoys are very unstable upon their immersion in the body of water.

SUMMARY OF THE INVENTION

An object of the invention is therefore to obtain a method for installing a rig comprising a lifting buoy, which is simple to apply, notably with ships which do not have any lifting cranes of great capacity.

For this purpose, the object of the invention is a method of the aforementioned type, characterized in that the buoy has a height, taken along a vertical axis when the intermediate section is tensioned, of less than 1.5 time its maximum transverse dimension, taken transversely with respect to the vertical axis, the step for bringing it comprising the displacement of the buoy between a remote position located away from the anchoring region and a position for setting it into place located facing the anchoring region, while maintaining the buoy partly immersed at the surface of the body of water.

The method according to the invention may comprise one or more of the following features taken individually or according to any technically possible combination(s):

- the intermediate section is flexible over substantially the whole length between the downstream point and the upstream point, the intermediate section being gradually deployed in the body of water between the downstream point attached on the buoy and a laying structure floating on the body of water during the deployment step;
- the step for connecting the downstream point comprises the immersion of the downstream point from the floating laying structure in the body of water, and traction of the downstream point towards the buoy, the intermediate section occupying a chain configuration between the floating laying structure and the buoy during the deployment step;
- the buoy comprises a floatability can and at least one traction unit for the downstream point, the traction unit being borne by the floatability can at least during the connection step, the connection step comprising actuation of the traction unit in order to move the downstream point back up onto the buoy;

the traction of the downstream point is achieved after complete immersion of the buoy under the surface of the body of water;

the displacement of the buoy comprises the towing of the partly immersed buoy in the body of water between its remote position and its placement position by at least one floating towing structure;

the buoy delimits a lumen for letting through the transport pipe opening out upwards and downwards, the step for connecting the downstream point comprising the introduction from bottom to top of the downstream point through the passage lumen;

the method comprises an additional step for connecting an auxiliary connecting point located on the upper flexible section downstream from the downstream connecting point between the transport pipe and the buoy with a connecting point located on the buoy;

the additional connecting step comprises the placement of a flexible link between the auxiliary connecting point located on the upper flexible section and the connecting point located on the buoy; and the buoy has a height, taken along a vertical axis when the intermediate section is tensioned, of greater than or equal to 1.5 time its maximum transverse dimension, taken transversely with respect to the vertical axis.

Further the object of the invention is an operating rig for a fluid through a body of water, of the type comprising:

a fluid transport pipe immersed in a body of water, the transport pipe comprising a lower connecting section intended to be connected to a bottom assembly producing fluid, an upper connecting flexible section intended to be connected to a surface assembly and an intermediate section placed between the upper flexible section and the lower section;

an element for anchoring the transport pipe in the bottom of the body of water, connected to an upstream point of the intermediate section;

a completely immersed buoy under the surface of the body of water, the buoy being connected to a downstream point of the intermediate section for maintaining the intermediate section located between the downstream point and the upstream point in a substantially vertical tensioned configuration, characterized in that the buoy has a height, taken along a vertical axis of less than 1.5 time its maximum transverse dimension, taken transversely to the vertical axis.

The rig according to the invention may comprise one or more of the following features, taken individually or according to any technically possible combination(s):

the intermediate section of the transport pipe is flexible over substantially the whole of its length between the upstream point and the downstream point;

an auxiliary connecting point located on the upper flexible section downstream from the downstream connecting point between the buoy and the transport pipe is connected with a connecting point located on the buoy;

the rig comprises a flexible link connecting the auxiliary connecting point located on the upper flexible section to the connecting point located on the buoy;

the auxiliary connecting point located on the upper flexible section is rigidly attached onto the connecting point located on the buoy; and the buoy comprises at least one stabilization unit capable of protruding downwards from a lower surface of the floatability can.

the buoy has a height, taken along a vertical axis when the intermediate section is tensioned, of greater than or equal to 1.5 time its maximum transverse dimension, taken transversely with respect to the vertical axis.

The object of the invention is further a method for assembling an operating rig for a fluid in a body of water of the type comprising the following steps:

bringing a buoy to the surface of the body of water substantially facing an anchoring region on the bottom of the body of water, the buoy comprising a floatability can;

connecting a downstream point of a fluid transport pipe onto the buoy;

completing immerging the buoy under the surface of the body of water before or after the connecting step;

deploying in the body of water an intermediate section of the transport pipe from the downstream point at least as far as one upstream point;

anchoring the upstream point on an anchoring element attached on the bottom of the body of water in the anchoring region;

tensioning the intermediate section of the transport pipe between the downstream point and the upstream point under the effect of the buoyancy of the buoy, in order to maintain the intermediate section substantially vertical in the body of water;

connecting onto the intermediate section, a lower section intended to be connected to the bottom assembly and an upper flexible section intended to be connected to the surface assembly;

additionally connecting an auxiliary connecting point located on the upper flexible section downstream from the downstream connection point between the buoy and the transport pipe with a connecting point located on the buoy or upstream from the buoy.

The method according to the invention may comprise one or more of the optional features of the method defined above, as well as one or more of the following features, taken individually or according to any technically possible combination (s):

the additional connecting step comprises the placement of a flexible link between the auxiliary connecting point located on the upper flexible section and the connecting point located on the buoy or upstream from the buoy;

the flexible link is positioned as a chain between the connecting point and the auxiliary connecting point;

the flexible link comprises an upstream region attached on the auxiliary connecting point, a downstream region attached on the connecting point and a ballast element connecting the downstream region to the upstream region;

the additional connecting step comprises rigid attachment of the auxiliary connecting point located on the upper flexible section on the connecting point located on the buoy.

the buoy has a height, taken along a vertical axis when the intermediate section is tensioned, of less than 1.5 time its maximum transverse dimension taken transversely with respect to the vertical axis, the step for bringing it comprising the displacement of the buoy between a remote position located away from the anchoring region and a placement position located facing the anchoring region, while maintaining the buoy partly immersed at the surface of the body of water.

The object of the invention is also an operating rig for a fluid through a body of water, of the type comprising:

a fluid transport pipe immersed in a body of water, the transport pipe comprising a lower connecting section intended to be connected to a bottom assembly producing fluid, an upper flexible connecting section intended to be connected to a surface assembly and an intermediate section placed between the upper flexible section and the lower section;

an anchoring element of the transport pipe in the bottom of the body of water, connected to an upstream point of the intermediate section;

a completely immersed buoy under the surface of the body of water, the buoy including a floatability can, the buoy being connected to a downstream point of the intermediate section in order to maintain the intermediate section located between the downstream point and the upstream point in a substantially vertical tensioned configuration, characterized in that an auxiliary connecting point located on the upper flexible section downstream from the downstream connecting point between the buoy and the transport pipe is connected with a connecting point located on the buoy or upstream from the buoy.

The rig according to the invention may comprise one or more of the optional features defined above, as well as one or more of the following feature(s), taken individually or according to any technical possible combination(s):

it comprises a flexible link between the auxiliary connecting point located on the upper flexible section and the connecting point located on the buoy or upstream from the buoy;

the flexible link is positioned as a chain between the connecting point and the auxiliary connecting point;

the flexible link comprises an upstream region fixed on the auxiliary connecting point, a downstream region fixed on the connecting point and a ballast element connecting the downstream region to the upstream region;

the auxiliary connecting point located on the upper flexible section is rigidly attached onto the connecting point located on the buoy;

the buoy comprises an attachment arm protruding laterally from the floatability can, the connecting point being located on the attachment arm;

the buoy comprises at least one stabilization unit capable of protruding downwards from a lower surface of the floatability can;

the stabilization unit is mobile with respect to the floatability can between an upper retracted configuration in the floatability can and a lower configuration deployed downwards from the floatability can.

the buoy has a height, taken along a vertical axis, of less than 1.5 time its maximum transverse dimension, taken transversely to the vertical axis.

BRIEF DESCRIPTION OF THE DRAWINGS

The invention will be better understood upon reading the following description, given only as an example, and made with reference to the appended drawings wherein.

DETAILED DESCRIPTION OF THE INVENTION

In the whole of the following, the terms of "upstream" and "downstream" are meant relatively to the normal direction of circulation of the fluid in a pipe.

Figure 1:
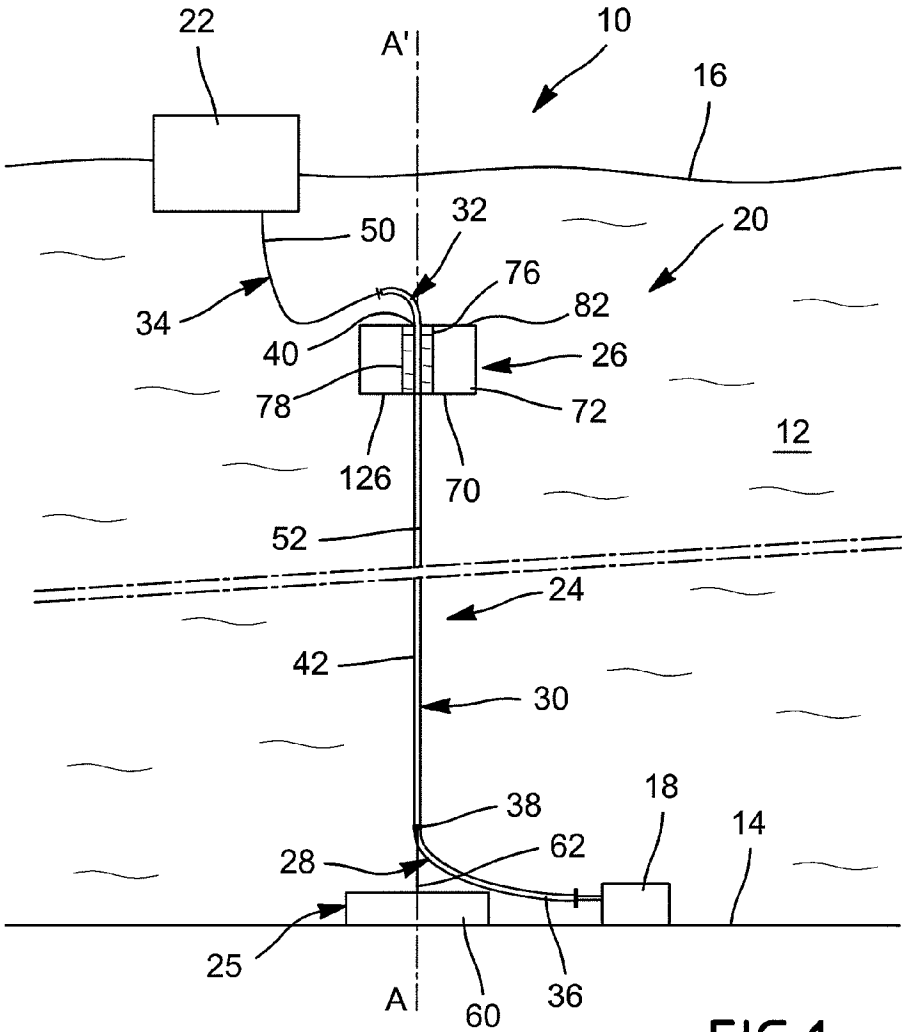
FIG. 1 is a schematic view taken as a partial sectional view along a median vertical plane of a first operating rig for a fluid according to the invention.

A first operating installation 10 for a fluid in a body of water 12, installed by a placement method according to the invention, is schematically illustrated in FIG. 1.

This installation is intended to convey a fluid collected in the bottom 14 of the body of water 12 toward the surface 16 of the body of water.

The collected fluid is for example a hydrocarbon gas or liquid stemming from a well (not shown) made in the bottom 14 of the body of water.

The body of water 12 is a lake, a sea or an ocean. The depth of the body of water 12, taken between the surface 16 and the bottom 14 facing the installation 10 is greater than 30 m and is for example comprised between 30 m and 3,500 m.

The installation 10 comprises a fluid production assembly 18 located on the bottom of the body of water, designated in the following by the term of "bottom assembly", a first rig 20 according to the invention and a surface assembly 22 intended for recovering and storing the fluid collected in the production assembly 18 conveyed through the rig 20.

The bottom assembly 18 for example comprises at least one well head and/or production line (not shown) located on the bottom 14 of the body of water.

The surface assembly 22 in this example is a floating assembly. For example it is formed by a ship, a barge, a floating platform or a floating unit for recovering, storing and treating hydrocarbons, designated by the acronym of <<FPSO>> (Floating Production Storage and Offloading). The surface assembly alternatively is a Floating Storage and Regasification Unit designated by the acronym of <<FSRU>>.

The surface assembly 22 floats on the body of water in the vicinity of the bottom assembly 18.

The rig 20 according to the invention comprises a fluid transport pipe 24 connecting the bottom assembly 18 to the surface assembly 22, an anchoring element 25 of the pipe 24, attached in the region of anchoring on the bottom 14, and a buoy 26 for maintaining under tension at least one intermediate section of the transport pipe 24 in a substantially vertical configuration in the body of water 12.

The transport pipe 24 comprises, from bottom to top in FIG. 1, a lower section 28 for connecting to the bottom assembly 18, an intermediate section formed by a substantially vertical rising column 30, a fitting 32 and an upper section 34 for connecting to the surface assembly 22.

In this example, the transport pipe 24 is flexible over substantially the whole of its length, taken between the bottom assembly 18 and the surface assembly 22.

The lower section 28 is for example formed with a lower flexible connecting pipe 36 extending in a bent or tilted way with respect to the bottom 14 of the body of water 12. The lower flexible pipe 36 is connected upstream to the bottom assembly 18 and is connected downstream to the rising column 30.

The rising column 30 extends substantially vertically along a vertical axis A-A' in the body of water 12, between a lower upstream point 38, connected to the anchoring element 25 and an upper downstream point 40 connected to the buoy 26.

In this example, the rising column 30 is formed with a flexible pipe 42 over substantially the whole of its length.

By <<flex>> or <<flexible pipe>> is meant in the sense of the present invention a pipe as described in the normative documents published by the American Petroleum Institute (API), API 17J and API RP17B, well known to one skilled in the art. This definition equally encompasses flexible pipes of the unbounded type or bounded type.

More generally and alternatively, the flexible pipe 42 may be a composite bundle of the <<bundle>> type comprising at least one fluid transport tube and one set of electrical or optical cables capable of conveying electrical or hydraulic power or a piece of information between the bottom 14 and the surface 16 of the body of water.

An exemplary flexible pipe is described in French application FR 2 911 907.

Such a flexible pipe has a relatively small minimum radius of curvature in flexure without any damage (MBR or minimal bending radius), for example of a few meters which makes it particularly able to be wound and unwound reversibly without any significant plastic deformation on a drum or a basket, the drum or the basket being borne by a laying ship, as this will be seen below.

The length of the rising column 30, taken between the upper point 40 and the lower point 38 is greater than 20 m and for example is comprised between 500 m and 3,500 m.

The fitting 32, typically a goose neck, is in this example attached on the buoy 26. It is connected upstream to the downstream point 40 of the rising column 30. It is connected downstream to the upper connecting section 34.

In this example, the fitting 32 is formed with a rigid tube with the shape of a goose spout.

Alternatively, the fitting 32 is formed with a flexible pipe as described above, for example provided with curvature limiters or floatability elements.

The upper section 34 is formed with an upper flex 50 extending between the fitting 32 and the surface assembly 22.

The upper flex 50 has a substantially J-shaped catenary configuration.

The upper flex 50 is deformable in order to absorb the movements of the surface assembly 22 due to the perturbations of the body of water such as due to the swell, current or wind. The section 34 thus substantially prevents transmission of these movements from the surface assembly 22 to the rising column 30, the downstream point 40 of which remains substantially motionless in the body of water.

The lower section 28, the rising column 30, the intermediate fitting 32, and the upper section 34 interiorly define a continuous passage 52 for fluid circulation extending between the bottom assembly 18 and the surface assembly 22 in order to allow transport of the fluid between these assemblies 18, 22.

In this example, the anchoring element 25 comprises an anchoring unit 60 attached in the anchoring region on the bottom 14 of the body of water and a flexible line 62 connecting the anchoring unit 60 to the upstream point 38 of the rising column.

The anchoring unit 60 is for example formed with a stack housed in the bottom 14 of the body of water or with a suction anchor.

The flexible line 62 extends vertically along the axis A-A' between the anchoring element 60 and the upstream point 38.

According to the invention, the buoy 26 is of a substantially flat shape when the rig 20 is mounted in the body of water 12.

The buoy 26 thus has a height, taken along the axis A-A' of less than its maximum transverse dimension, taken perpendicularly to the axis A-A'.

Figure 2:
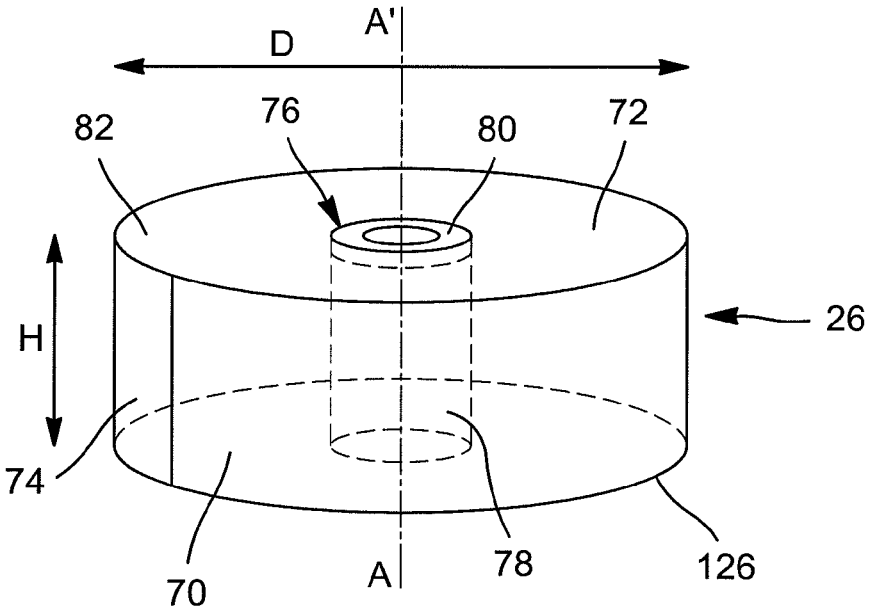
FIG. 2 is a schematic perspective view of an exemplary buoy intended for the rig of FIG. 1.

As illustrated by FIG. 2, the buoy 26 is advantageously of a cylindrical shape of axis A-A'. The height H of the buoy is advantageously less than 1.5 time, notably less than or equal to once the maximum transverse dimension of the buoy, which in this example is the diameter D of the cylinder.

Alternatively, the height H of the buoy is greater than or equal to 1.5 time the maximum transverse dimension of the buoy.

The buoy 26 comprises a floatability can 70 interiorly delimiting at least one sealed compartment 72 capable of being selectively filled with gas or liquid, and selective means 74 for filling the compartment 72 with liquid and gas.

The buoy 26 further comprises means 76 for connecting to the downstream point 40 of the rising column 30, visible in FIG. 1.

In the example illustrated in FIGS. 1 and 2, the floatability can 70 delimits a through-lumen 78 of axis A-A' for letting through the rising column 30. The lumen 78 opens out upwards and downwards on either side of the can 70.

Said or each compartment 72 extends around the lumen 76 in the can 70.

The filling means 74 are capable of selectively introducing gas or liquid into said or each compartment 72 in order to selectively increase or decrease the buoyancy of the buoy 26.

In the example illustrated in FIG. 1, the connecting means 76 comprise at least one attaching collar 80, attached on the downstream point 40 of the column 30.

The rising column 30 is introduced into the lumen 78 as far as its downstream point 40. The downstream point 40 is firmly attached to the buoy 26 via the collar 80.

The fitting 32 protrudes from an upper surface 82 of the buoy 26.

A first method for setting into place the installation 10 according to the invention will now be described with reference to FIGS. 3 to 6.

This method is applied by means of a ship 90 for laying the transport pipe 24 and by means of at least one ship 92A, 92B for towing the buoy 26, distinct from the laying ship 90. In the example illustrated in FIG. 3, the method is applied by means of two tug boats 92A, 92B.

Initially, the pipe elements 36, 42, 50 intended to form the transport pipe 24 are brought to the vicinity of the bottom assembly 18 by means of the laying ship 90.

For this purpose, the lower flexible 36, the upper flexible 50 and the flexible pipe 42 are transported by the laying ship 90 while for example being wound on a laying drum or in a basket.

The anchoring element 25 is installed in the bottom of the body of water in the vicinity of the bottom assembly 18. For this purpose, the anchoring unit 60 is attached in the bottom 14 of the body of water.

According to the invention, the buoy 26 is towed while being partly immersed, with its upper surface 82 located out of the body of water 12, between a remote position away from the anchoring region of the element 25 and a placement position substantially located facing and above the anchoring region of the element 25.

During this transport, the buoy 26 extends substantially horizontally with its axis A-A' being vertical.

As the buoy 26 has a substantially flat shape, it is not very sensitive to the movements of the surface 16 of the body of water 12, and notably to the swell, to the current or to the wind, so that it may be transported safely while only being partly immersed in the body of water 12, by means of the tug boats 92A, 92B. It is also a work station by means of its wide flat upper surface 82.

The towing distance of the buoy 26, which horizontally separates the remote position from the placement position is greater than a few hundreds of meters, or even several hundreds of kilometers.

In one alternative, the buoy 26 is loaded on board a partly submersible barge, and is then immersed in the water by immersion of the barge, before being towed.

Figure 3:
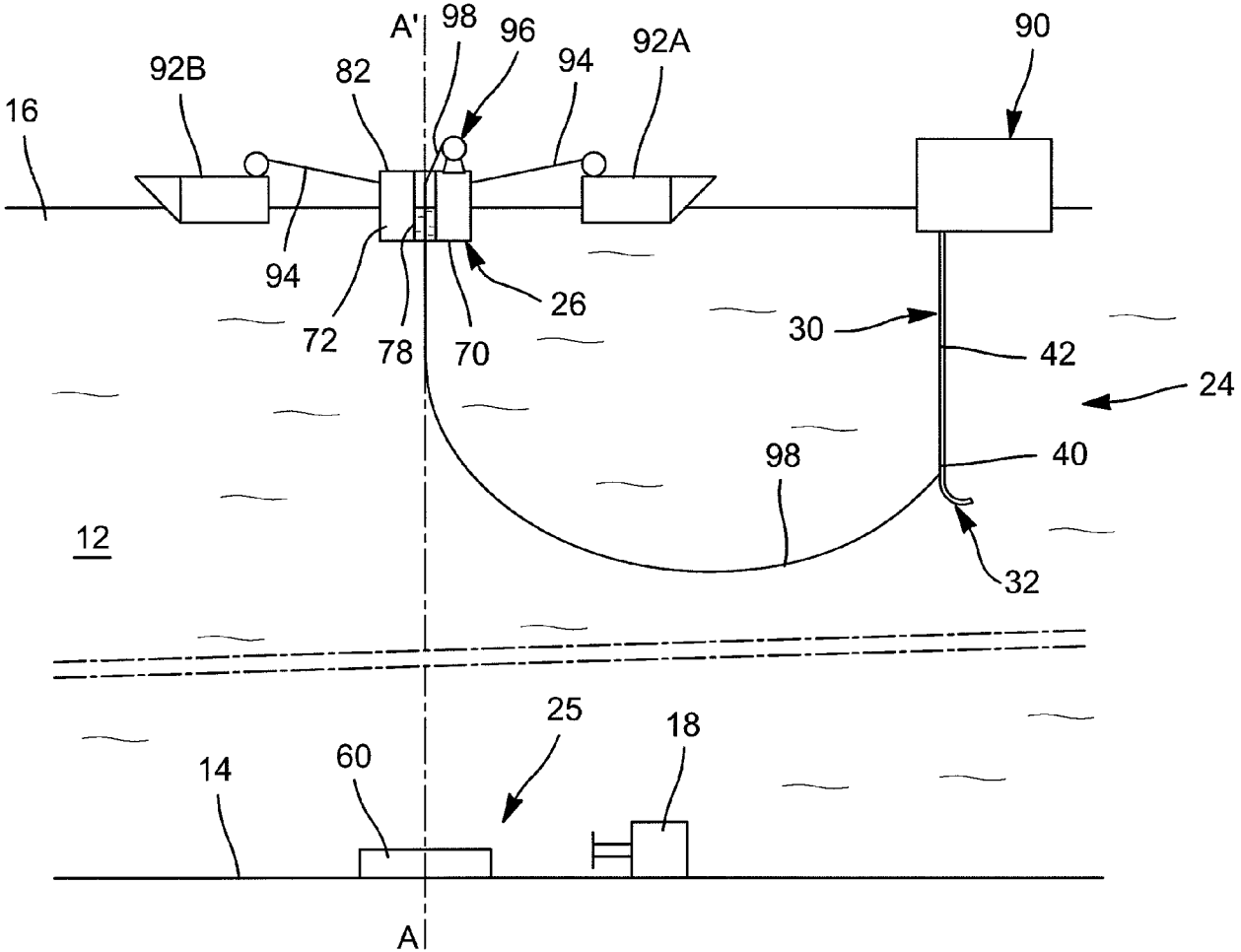
FIG. 3 is a view similar to FIG. 1 during a first step for setting into place the rig of FIG. 1 with the method according to the invention.
Figure 4:
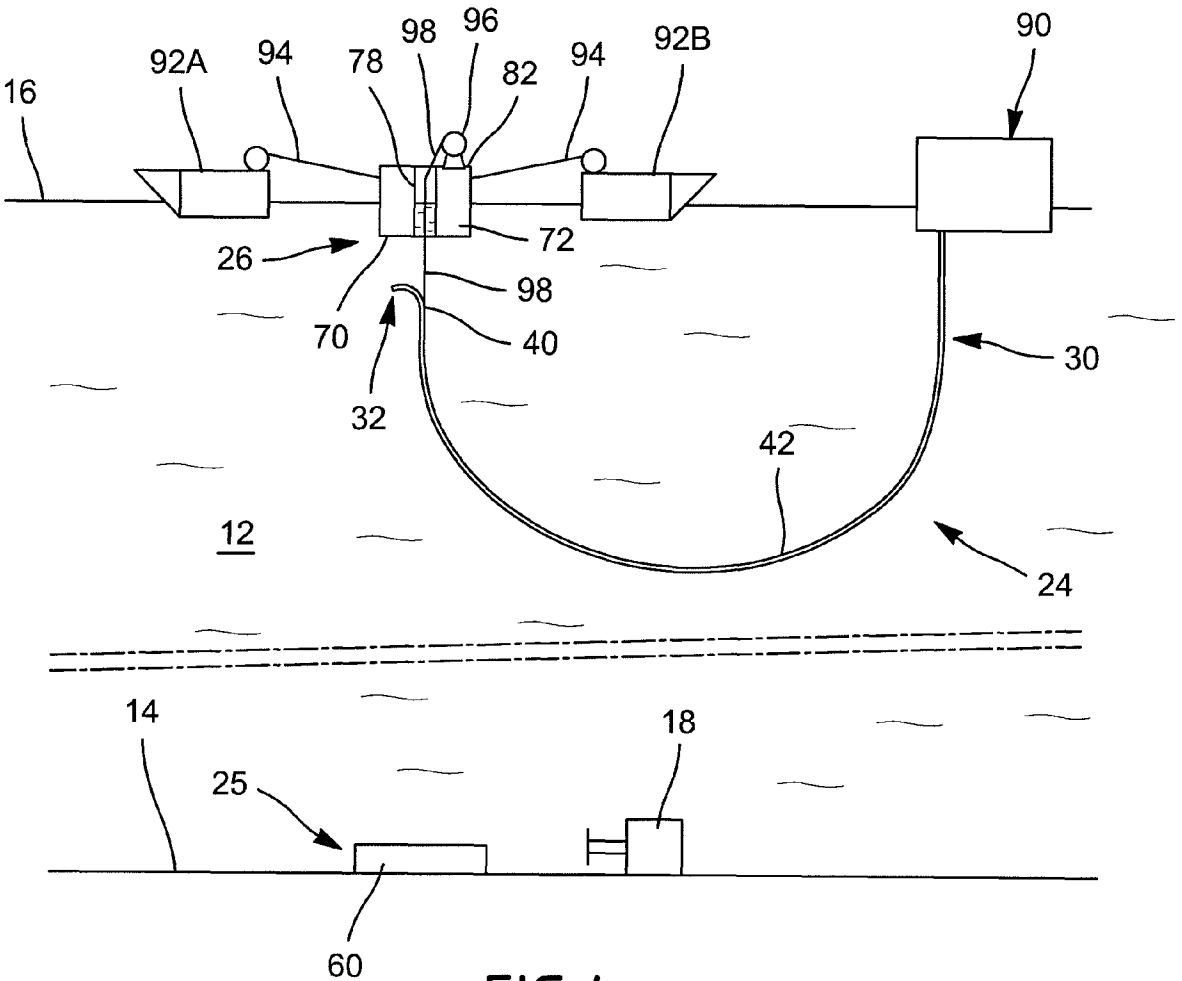
FIG. 4 is a similar view to FIG. 3 during a second step of the method according to the invention.

Next, when the buoy 26 occupies its placement position illustrated in FIG. 3, it is maintained in the horizontal position by the tug boats 92A, 92B by means of deployable mooring lines 94.

A traction device 96 is then mounted on the buoy 26, for example on its upper surface 82. This traction device 96 is notably formed by a winch 96 including a deployable traction line 98.

The line 98 is unwound so as to be introduced from top to bottom through the central lumen 78 of the buoy 26. The line 98 is then brought as far as the laying ship 90 in order to be connected to the flexible pipe 42 at the downstream point 40.

The winch 96 is then actuated in order to bring the downstream point 40 closer to the buoy 26, by retracting an increasing length of the line 98 onto the winch 96. Simultaneously, an increasing length of the flexible pipe 42 is unwound out of the laying ship 90. The flexible pipe 42 adopts a substantially U catenary shape between the laying ship 90 and the buoy 26.

As the distance separating the laying ship 90 from the buoy 26 is relatively large, for example of more than 50 m, the radius of curvature of the flexible pipe 42 in this configuration is large in order to prevent any damage of the flexible pipe 42.

Further as the weight of the flexible pipe 42 is distributed among the laying ship 90 and the buoy 26, it is not necessary to provide the buoy 26 or the laying ship 90 with a large capacity winch 96.

Traction of the line 98 is continued until the fitting 32 and the downstream point 40 enter the lumen 78 from the bottom, and then move upwards along the lumen 78 before being extracted out of the lumen 78 from the top.

In this configuration, the fitting 32 protrudes upwards from the upper surface 82. The downstream point 40 is substantially located at the upper surface 82.

The attaching collar 80 is then set into place in order to immobilize the downstream point 40 relatively to the buoy 26.

The traction line 98 is then disconnected from the downstream point 40 and the winch 96 is disassembled away from the buoy 26.

The mooring lines 94 are then released and the filling means 74 are actuated in order to introduce liquid into the compartments 72 in order to reduce the buoyancy of the buoy 26.

Figure 5:
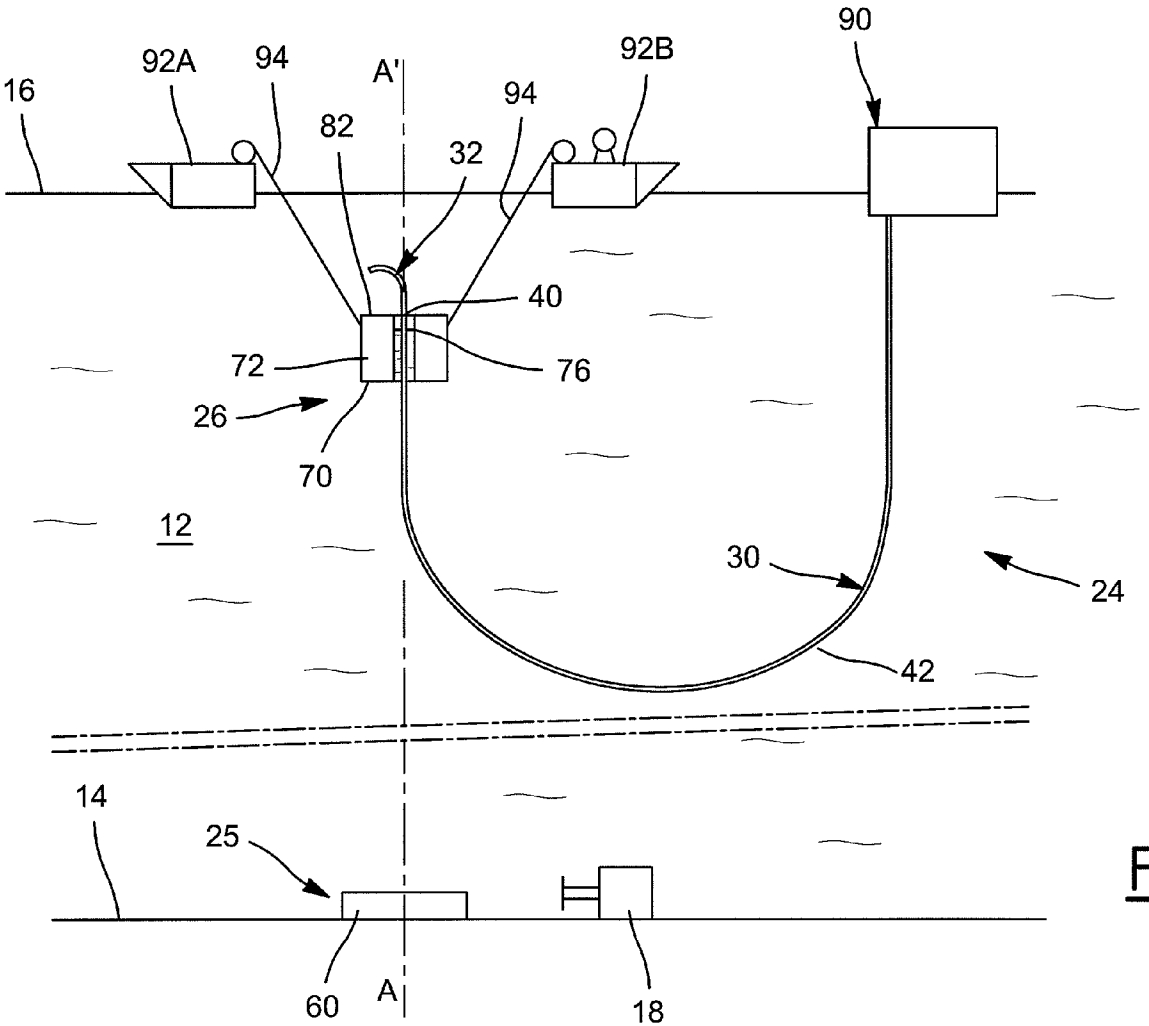
FIG. 5 is a similar view to FIG. 3 during a third step of the method according to the invention.

The buoy 26 is then moved down and completely immersed in the body of water 12, down to a depth of more than several tens of meters, in a region of the body of water 12 which is not affected by the swell or the waves, as illustrated in FIG. 5.

The buoy 26 retains its horizontal orientation upon moving down, with its axis A-A' substantially vertical along its height.

A corresponding length of the flexible pipe 42 is unwound out of the laying ship 90.

The increasing weight of the deployed flexible pipe 42 promotes the moving down of the buoy 26 into the body of water 12.

Next, the deployment of the flexible pipe 42 is continued until the upstream point 38 is located in the vicinity of the surface 16 of the body of water.

The flexible pipe 42 is then completely immersed and the upstream point 38 is moved down under the downstream point 40 as far as the vicinity of the bottom 14 facing the anchoring element 25.

The upstream point 38 of the flexible pipe 42 is then attached on the anchoring element 60 via the anchoring line 62.

Figure 6:
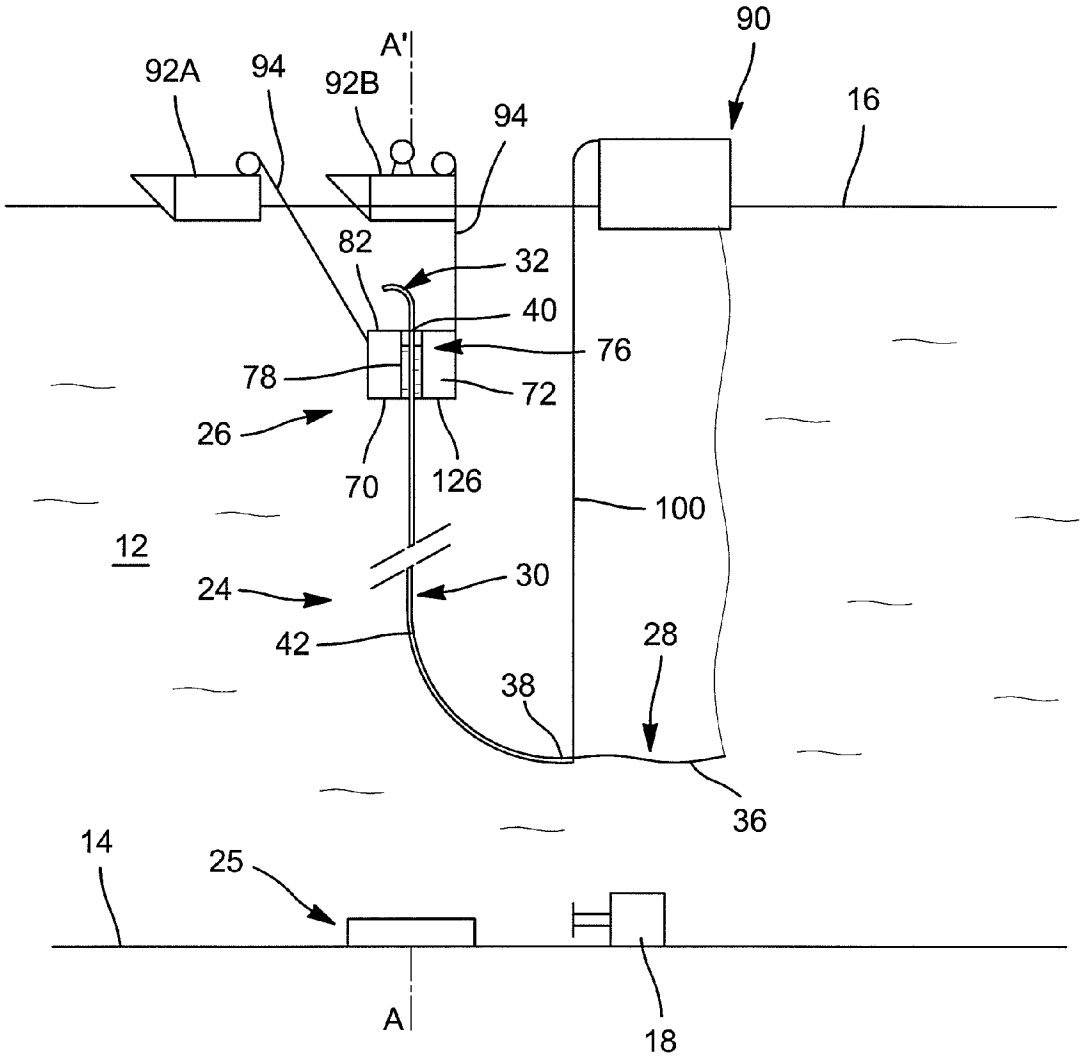
FIG. 6 is a similar view to FIG. 3 during a fourth step of the method according to the invention.

A lower flex 36 is moved down with a deployed release line 100 from the laying ship 90, as illustrated by FIG. 6.

The lower flex 36 is then connected to the rising column 30 and onto the bottom assembly 18 in order to form the lower section of the transport pipe 24.

Next, the buoyancy of the buoy 26 is optionally modified in order to apply between the downstream point 40 and the upstream point 38, via the buoy 26, a tractive force directed upwards, this force being compensated by the retaining force provided by the anchoring line 62.

The flexible pipe 42 thus forms, between the upstream point 38 and the downstream point 40, a rising column 30 extending vertically along the axis A-A', maintained in a vertical position and tensioned along the axis A-A' between the buoy 26 and the anchoring element 25.

Next, the upper flex 50 is moved down into the body of water 12 in order to be connected to the fitting 32 and to the surface assembly 22, thereby forming the upper section 34 of the pipe 24.

The continuous passage 52 for circulation of hydrocarbons between the bottom assembly 18 and the surface assembly 22 is then successively established through the lower section 28, the rising pipe 30, the fitting 32 and the upper section 34. The fluid collected by the bottom assembly 18 is then transported up to the surface assembly 22 through the passage 52.

In an alternative installation method described earlier, the buoy 26 is immersed under the body of water, before the downstream point 40 of the rising column 30 is attached onto the buoy.

The buoy 26 is then provided with an actuatable winch 96 while being immersed under the body of water 12.

Figure 7:
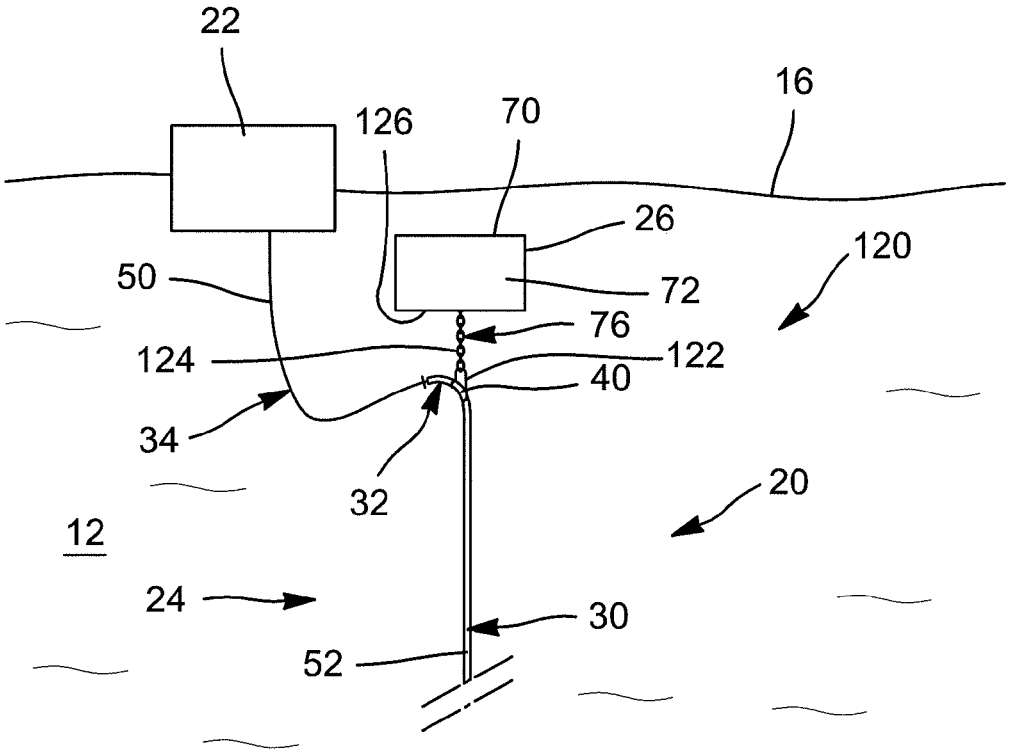
FIG. 7 is a partial sectional view along a median vertical plane of a second operating rig for a fluid according to the invention.

A second installation 120 according to the invention is illustrated in FIG. 7. Unlike the rig 20 of the first installation 10, the rig 20 of the second installation 120 comprises a buoy 26 positioned above the downstream point 40 and above the fitting 32.

The connecting means 76 comprise a ring 122 firmly attached to the flexible pipe 42 at the downstream point 40 and a flexible chain 124 connecting the ring 122 to a lower surface 126 of the buoy 26.

By means of the invention which has just been described, it is possible to tow the buoy 26 from the rig 20 as far as its placement position by having it float on the body of water 12. It is therefore not necessary to convey it on a laying ship equipped with a large capacity crane and to lower it into the body of water with the large capacity crane.

Further, the method for placing the rig 20 is notably facilitated by the placement of a large capacity winch on the buoy 26 in order to pull the downstream point 40 of the transport pipe 30 and to deploy this pipe as a chain between the laying ship 90 and the buoy 26.

The buoy 26 is moreover stable upon its immersion into the body of water 12. It substantially retains its orientation during its downward motion, which facilitates its handling.

In an alternative (not shown), the lower section 28 of the pipe 24 is formed by a rigid tubular element which cannot be wound onto a drum or in a basket without any substantial plastic deformation.

In this case, the intermediate section 30 is flexible over substantially the whole of its length.

In another embodiment, the upstream point 38 of the flexible pipe 42 is directly attached on the anchoring element 60 immobilized in the bottom of the body of water 12 without using any flexible anchoring line 62.

Figure 8:
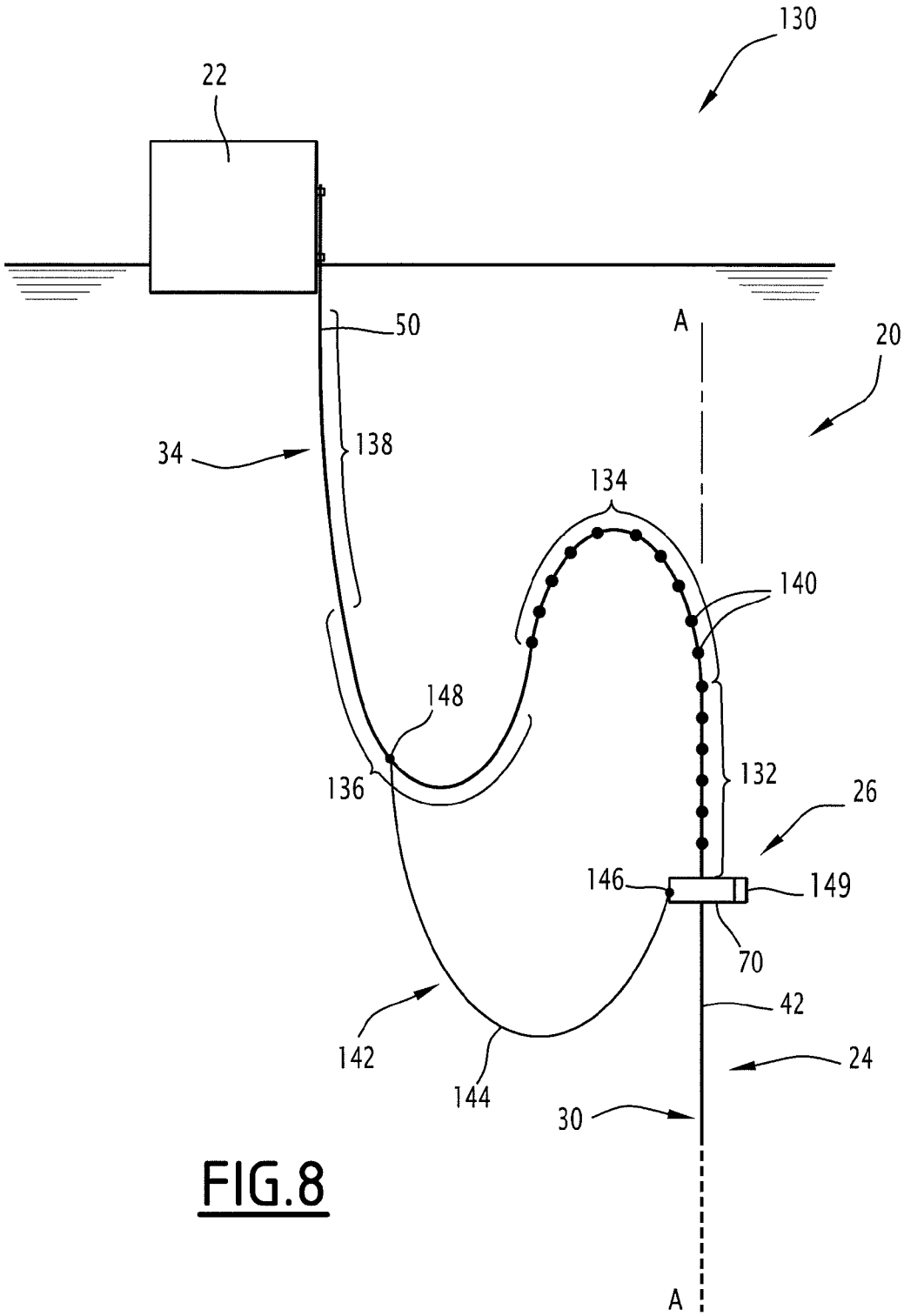
FIG. 8 is an enlarged schematic view of a detail of a third operating rig for a fluid according to the invention.

A third operating installation 130 according to the invention is illustrated in FIG. 8.

Unlike the first installation 10, the upper section 34 is connected onto the intermediate section 30 at the buoy 26, for example on the upper surface of the floatability can 70. The rig 20 is without any gooseneck spout rigid fitting 32.

The upper section 34 comprises, from upstream to downstream, a first substantially vertical section 132 connected to the buoy, a second curved section 134 with the shape of a U with its concavity directed downwards, a third curved section 136 with the shape of a U with its concavity directed upwards 136 and a fourth substantially vertical section 138 connected to the surface assembly 22.

The first section 132 and the second section 134 are provided with floats 140 distributed over their length in order to ensure that the flexible upper section 34 is maintained in a wave configuration, designated by the term of "steep-wave".

The rig 20 further comprises a means 142 for limiting the torsional movements of the rising column 30. In this example, the means 142 is formed by a continuous flexible link 144 connecting a first connecting point 146 located on the buoy 26 to an auxiliary connecting point 148 located on the upper flexible section 34 away from the connection point between the intermediate section 30 and the upper section 34, and away from the downstream attachment point 40 on the buoy 26.

In the example illustrated in FIG. 8, the link 144 is substantially continuous over the whole of its length. It is hung as a chain between the points 146, 148.

The connecting point 146 is located on a side surface of the floatability can 70 located on the same side as the third section 136 of the flexible upper section 34.

The auxiliary connection point 148 is located on a rising portion of the third U-shaped section 136 away from the lowest point.

The buoy 26 further comprises a ballast element 149 located opposite the connecting point 146 with respect to a vertical axis of the can 70, in order to compensate the weight of the flexible link 144.

At least one portion of the transport pipe 24 with non-zero length extends between the downstream point 40 located on the buoy and the auxiliary connecting point 148 located above and away from the buoy 26.

During the manufacturing method, the flexible link 144 is mounted between the connecting point 146 and the auxiliary connecting point 148, once the flexible section 34 is connected to the rising column 30.

The flexible link 144 then generates a frictional force in the water, substantially perpendicular to the vertical axis A-A' of the rising column 30 preventing or limiting torsion of this column 30.

Figure 9:
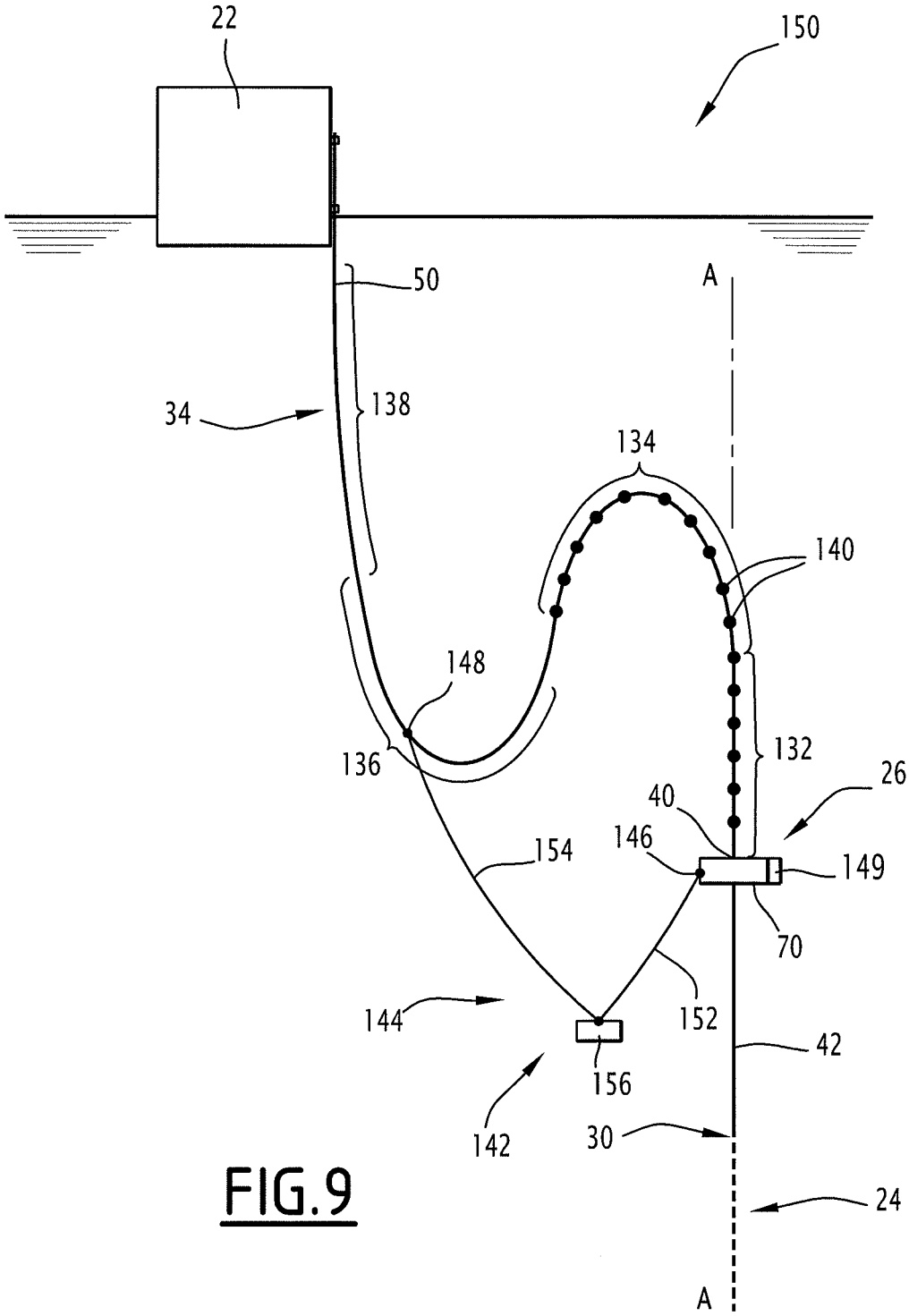
FIG. 9 is a similar view to FIG. 8 of a fourth operating rig for a fluid according to the invention.

A fourth installation 150 according to the invention is illustrated in FIG. 9. Unlike the third installation 130, the flexible link 144 forming the means 142 for limiting torsion includes an upstream flexible region 152 attached on the connection point 146, a downstream flexible region 154 attached on the auxiliary connecting point 148 and a ballast element 156 connecting the upstream flexible region 152 and the downstream flexible region 154 to their lower points.

Thus, the flexible link 144 substantially has the shape of a V.

The mounting and operation of the fourth installation 150 is moreover identical with that of the third installation 130.

Figure 10:
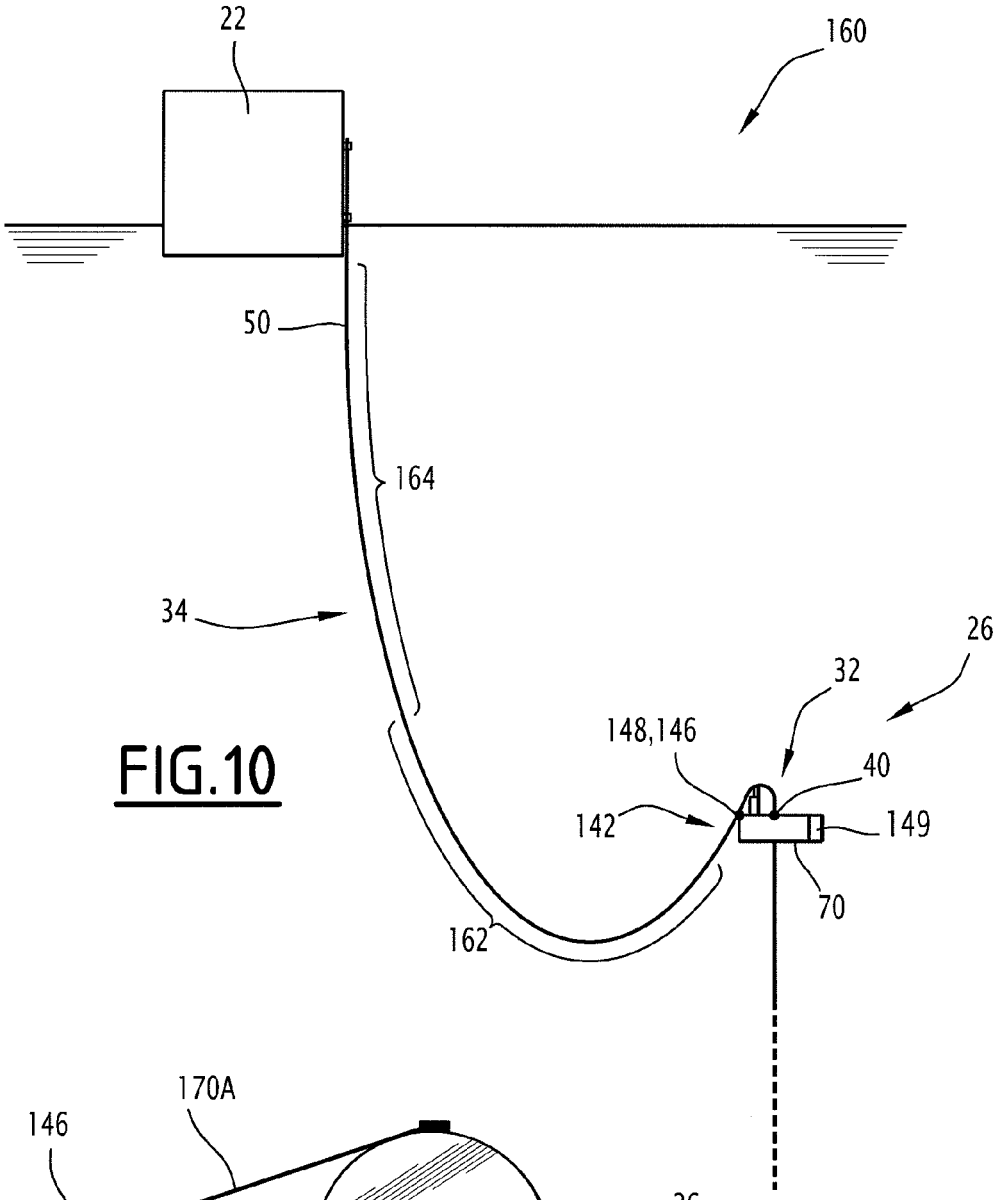
FIG. 10 is a similar view to FIG. 8 of a fifth operating rig according to the invention.

A firth installation 160 according to the invention is illustrated in FIG. 10.

Unlike the third installation 130 illustrated in FIG. 8, the transport pipe 24 comprises a gooseneck spout fitting 32 interposed above the buoy 26.

The auxiliary connection point 148 is located at the upstream end of the flexible upper section 34, or slightly downstream from this end. It is rigidly attached to a connection point 146 defined on the periphery of the floatability can 70.

In this configuration, the upper flexible section 34 has a catenary shape with a lower section 162 substantially with the shape of a U with concavity directed downwards and an upper substantially vertical section 164 connected to the surface assembly 22.

In this case, the limiting means 142 are formed by the rigid connection between the auxiliary connecting point 148 and the connecting point 146.

Figure 11:
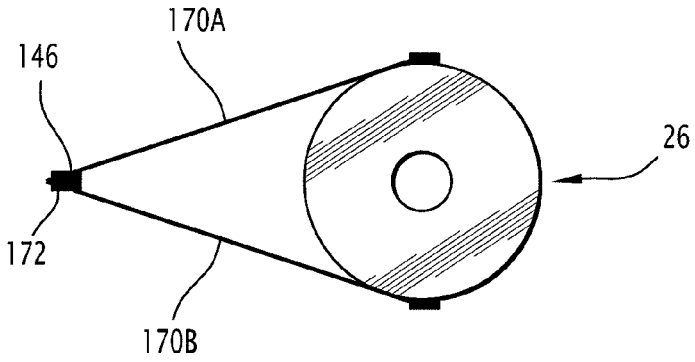
FIG. 11 is a partial top view of an alternative buoy for an operating rig according to the invention.

In the alternative illustrated in FIG. 11, the buoy 26 has two connecting side arms 170A, 170B which protrude laterally away from the floatability can. Each arm 170A, 170B has a free end 172 connected to the other arm in order to thereby define a support with a general triangular shape.

The attachment point 146 is located at the free ends 172, radially away from the periphery of the floatability can 70.

Figure 12:
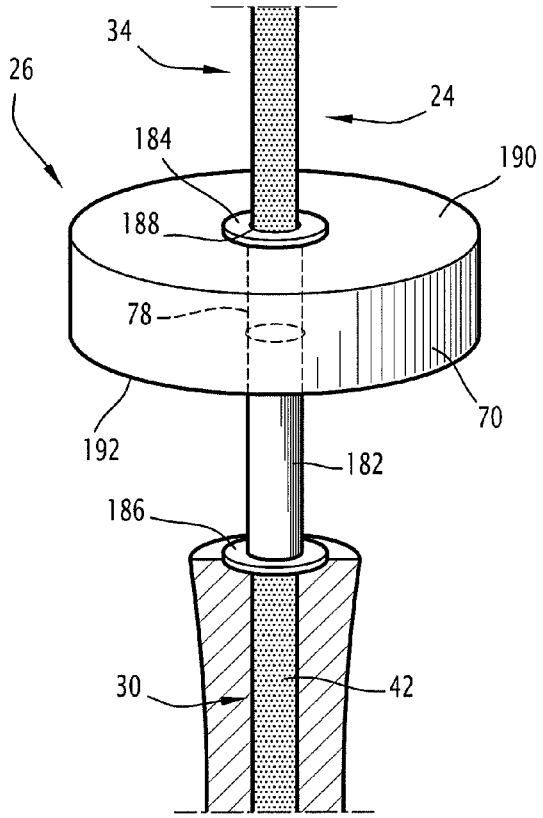
FIG. 12 is a schematic perspective view of another alternative buoy for a rig according to the invention, the buoy being installed on the rig and comprising a stabilization unit in a deployed configuration.
Figure 13:
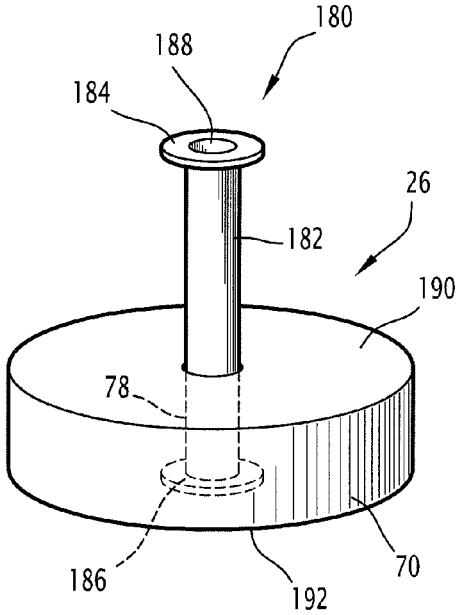
FIG. 13 is a similar view to FIG. 12, before the installation of the rig, the stabilization unit occupying a retracted configuration.

In another alternative, illustrated in FIGS. 12 and 13, the buoy 26 comprises a stabilization unit 180 moveably mounted in the central lumen 78 of the floatability can 70.

The stabilization unit 180 is formed with a vertical rigid hollow tube 182 provided at its ends with abutment flanges 184, 186. It interiorly defines a channel 188 for letting through the transport pipe 24.

The stabilization unit 180 is moveably mounted in the floatability can 70 along a vertical axis A-A' between a retracted upper configuration, illustrated in FIG. 13 and a deployed lower configuration illustrated in FIG. 12.

In the retracted upper configuration, used during the transport of the can 70 on the ship, the rigid tube 182 protrudes upwards from an upper surface 190 of the floatability can 70. The length of the rigid tube 182 protruding downwards from a lower surface 192 of the floatability can 70 is minimal or even zero. The draught of the buoy 26 is thus substantially equal to that of the floatability can 70.

In the deployed configuration illustrated in FIG. 12, the tube 182 has been moved downwards. Its protruding length from the lower surface 192 is maximum. The draught of the buoy 26 is then much larger than that of the floatability can 70, which increases the stability of the buoy 26 when it is partly immersed in the body of water.

The end flange 184 is positioned so as to bear upon the upper surface 190 in order to retain the tube 182.

In this configuration, the transport pipe 24 is positioned through the channel 188 as illustrated in FIG. 12.

The invention claimed is:

1. A method for assembling an operating rig for a fluid in a body of water, of the type comprising the following steps:

bringing a buoy to a placement position at a surface of the body of water and at the placement position to which the buoy is brought, the buoy is substantially facing an anchoring region at the bottom of the body of water, the bringing of the buoy comprising displacing the buoy by towing the buoy, while the buoy is partly immersed in the body of water, between a remote position of the buoy which is remote from the placement position and the placement position of the buoy by displacing at least one floating towing structure for towing the buoy between the remote position located away from an anchoring region at the placement position and the placement position located facing the anchoring region, while maintaining the buoy partly immersed at the surface of the body of water during the towing;

when the buoy is at the placement position;

connecting a downstream point of a fluid transport pipe to the buoy;

completely immersing the buoy under the surface of the body of water before or after the connection step;

deploying in the body of water an intermediate section of the transport pipe from the downstream point to at least as far as an upstream point of the pipe;

anchoring the upstream point on an anchoring element fixed on the bottom of the body of water in the anchoring region;

tensioning the intermediate section of the transport pipe between the downstream point and the upstream point under the effect of the buoyancy of the buoy, in order to maintain the intermediate section substantially vertical in the body of water;

connecting on the intermediate section a lower section intended to be connected to the bottom assembly and an upper flexible section intended to be connected to the surface assembly;

wherein the buoy has a height, taken along a vertical axis (A-A') when the intermediate section is tensioned, of less than 1.5 time its maximum transverse dimension, taken transversely with respect to the vertical axis (A-A'); and the intermediate section is formed by a flexible pipe, the flexible pipe being capable of being wound and unwound reversibly without any significant plastic deformation on a drum or on a basket.

2. The method according to claim 1, wherein the intermediate section is flexible over substantially the whole of its length between the downstream point and the upstream point, the intermediate section being gradually deployed in the body of water between the downstream point fixed on the buoy and a laying structure floating on the body of water during the deployment step, the flexible section being unwound from the laying structure on which it is transported while being wound on a laying drum or on a basket.

3. The method according to claim 1, wherein the buoy delimits a lumen for letting through the transport pipe opening out upwards and downwards, the step for connecting the downstream point comprising introducing of the downstream point through the passage lumen from bottom to top.

4. The method according to claim 1, further comprising an additional step for connecting an auxiliary connecting point, which is located on the upper flexible section downstream from the downstream connecting point, between the transport pipe and the buoy with a connecting point located on the buoy.

5. The method according to claim 4, wherein the additional connecting step comprises placing a flexible link between the auxiliary connecting point located on the upper flexible section and the connecting point located on the buoy; the intermediate section is formed with a flexible pipe, the flexible pipe being configured for being wound and unwound reversibly without significant plastic deformation on a drum or on a basket.

6. A method for assembling an operating rig for a fluid in a body of water, comprising the following steps:

bringing a buoy to a surface of the body of water substantially facing an anchoring region on the bottom of the body of water;

connecting a downstream point of a fluid transport pipe to the buoy;

completely immersing the buoy under the surface of the body of water before or after the connection step;

deploying in the body of water an intermediate section of the transport pipe from the downstream point to at least as far as an upstream point of the pipe;

anchoring the upstream point on an anchoring element fixed on the bottom of the body of water in the anchoring region;

tensioning the intermediate section of the transport pipe between the downstream point and the upstream point under the effect of the buoyancy of the buoy, in order to maintain the intermediate section substantially vertical in the body of water;

connecting on the intermediate section a lower section intended to be connected to the bottom assembly and an upper flexible section intended to be connected to the surface assembly;

wherein the buoy has a height, taken along a vertical axis (A-A') when the intermediate section is tensioned, of less than 1.5 time its maximum transverse dimension, taken transversely with respect to the vertical axis (A-A'), the step for bringing the buoy comprising displacing the buoy between a remote position located away from the anchoring region and a placement position located facing the anchoring region, while maintaining the buoy partly immersed at the surface of the body of water;

the intermediate section is formed by a flexible pipe, the flexible pipe being capable of being wound and unwound reversibly without any significant plastic deformation on a drum or on a basket;

wherein the intermediate section is flexible over substantially the whole of its length between the downstream point and the upstream point, the intermediate section being gradually deployed in the body of water between the downstream point fixed on the buoy and a laying structure floating on the body of water during the deployment step, the flexible section being unwound from the laying structure on which it is transported while being wound on a laying drum or on a basket; and wherein the step for connecting the downstream point comprises immersion of the downstream point from the floating laying structure into the body of water, and traction of the downstream point towards the buoy, the intermediate section occupying a chain configuration between the floating laying structure and the buoy during the deployment step.

7. The method according to claim 6, wherein the buoy comprises a floatability can and at least one device for pulling the downstream point, the traction device being borne by the floatability can at least during the connection step, the connection step comprising actuating the traction device for raising the downstream point on the buoy.

8. The method according to claim 7, wherein the traction of the downstream point is achieved after complete immersion of the buoy under the surface of the body of water.

9. The method according to claim 6, wherein the traction of the downstream point is achieved after complete immersion of the buoy under the surface of the body of water.

* * * * *